US008573233B2

(12) United States Patent
Chen

(10) Patent No.: US 8,573,233 B2
(45) Date of Patent: Nov. 5, 2013

(54) COSMETIC CONTAINER WITH TRANSPARENT WINDOW

(76) Inventor: Sin-Hsiung Chen, Tainan (TW)

( * ) Notice: Subject to any disclaimer, the term of this patent is extended or adjusted under 35 U.S.C. 154(b) by 383 days.

(21) Appl. No.: 13/066,942

(22) Filed: Apr. 28, 2011

(65) Prior Publication Data

US 2012/0272997 A1 Nov. 1, 2012

(51) Int. Cl.
*A45D 33/20* (2006.01)

(52) U.S. Cl.
USPC ..... 132/287; 206/581; 132/314; 132/291

(58) Field of Classification Search
USPC ..... 132/287, 301–306, 314–318, 291, 292, 132/294; 206/581, 6.1, 1.5, 823, 38, 235, 206/39.4, 251, 742, 754; 220/4.22, 4.27, 220/345.1, 345.2, 345.3, 348, 351, 500, 220/520, 523, 524, 528, 532–533
See application file for complete search history.

(56) References Cited

U.S. PATENT DOCUMENTS

2004/0200497 A1* 10/2004 Thorpe et al. ..... 132/287
2009/0288677 A1* 11/2009 Chen ..... 132/315

FOREIGN PATENT DOCUMENTS

| | | |
|---|---|---|
| EP | 2208434 | 7/2010 |
| JP | 61146226 | 9/1986 |
| KR | 20080036823 | 4/2008 |

OTHER PUBLICATIONS

European Search Report dated Jul. 20, 2011, Application No. 11164120.5-1258.

* cited by examiner

*Primary Examiner* — Robyn Doan
*Assistant Examiner* — Brianne Kalach
(74) *Attorney, Agent, or Firm* — William E. Pelton; Cooper & Dunham LLP

(57) ABSTRACT

A cosmetic container with a transparent window has a main base, a cover with the transparent window and mounted on the main base, a lateral movement base mounted between the main base and the cover, a longitudinal movement base mounted on the main base and a transmission element connecting to the lateral and longitudinal movement bases. The transparent window allows a user to recognize kinds and colors of cosmetics that are mounted on the lateral movement base therethrough. When the transmission element is driven by the longitudinal movement base, the transmission element drives the lateral movement base consequently to push the lateral and longitudinal movement bases outwardly. Thus, it is easy to open or close the cosmetic container with only one hand.

14 Claims, 6 Drawing Sheets

COSMETIC CONTAINER WITH TRANSPARENT WINDOW

BACKGROUND OF THE INVENTION

1. Field of the Invention

The present invention relates to a cosmetic container, especially to a cosmetic container that allows a user to see kinds and colors of cosmetics stored in the cosmetic container through a transparent window.

2. Description of the Prior Art(s)

Seeking beauty is part of women's inborn nature. Women apply cosmetics to allow themselves to be in good looks. Common cosmetics can be distinguished into foundation and decorative cosmetics. The foundation includes powder foundation, pressed-powder foundation, face powder, concealer and the like. The decorative cosmetics include eyeliner, eye shadow, blusher, lipstick and the like. The aforementioned cosmetics are stored in cosmetic containers. A conventional cosmetic container comprises a base and a cover. The base has multiple recesses and a hook. The recesses are used for storing the cosmetics. The cover is pivotally mounted on the base, selectively covers the recesses of the base and has an outer surface painted with patterns, a mirror mounted on an inner surface of the cover and a hook corresponding to and selectively engaging the hook of the base. Thus, when a user is to apply makeup, he/she opens the cover of the conventional cosmetic container first, and then uses the cosmetics stored in the recesses of the base while looking at himself/herself in the mirror.

For the convenience of applying and freshening makeup, the cosmetics that are often used are put in cosmetic bags. However, since the mirror is mounted on the cover or the cover is opaque, the user is unable to see kinds or colors of the cosmetics that are stored in the conventional cosmetic container without opening the cover of the conventional cosmetic container. Thus, it is troublesome to find the cosmetic that the user wants. Moreover, the user is unable to open the conventional cosmetic container with only one hand. Therefore, it is inconvenient and time-consuming to apply makeup with the conventional cosmetic container.

To overcome the shortcomings, the present invention provides a cosmetic container with a transparent window to mitigate or obviate the aforementioned problems.

SUMMARY OF THE INVENTION

The main objective of the present invention is to provide a cosmetic container with a transparent window. The cosmetic container has a main base, a cover with the transparent window and mounted on the main base, a lateral movement base mounted between the main base and the cover, a longitudinal movement base mounted on the main base and a transmission element connecting to the lateral and longitudinal movement bases.

The transparent window allows a user to recognize kinds and colors of cosmetics that are mounted on the lateral movement base. When the transmission element is driven by the longitudinal movement base, the transmission element drives the lateral movement base consequently to push the lateral and longitudinal movement bases outwardly. Thus, it is easy to open or close the cosmetic container with only one hand.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
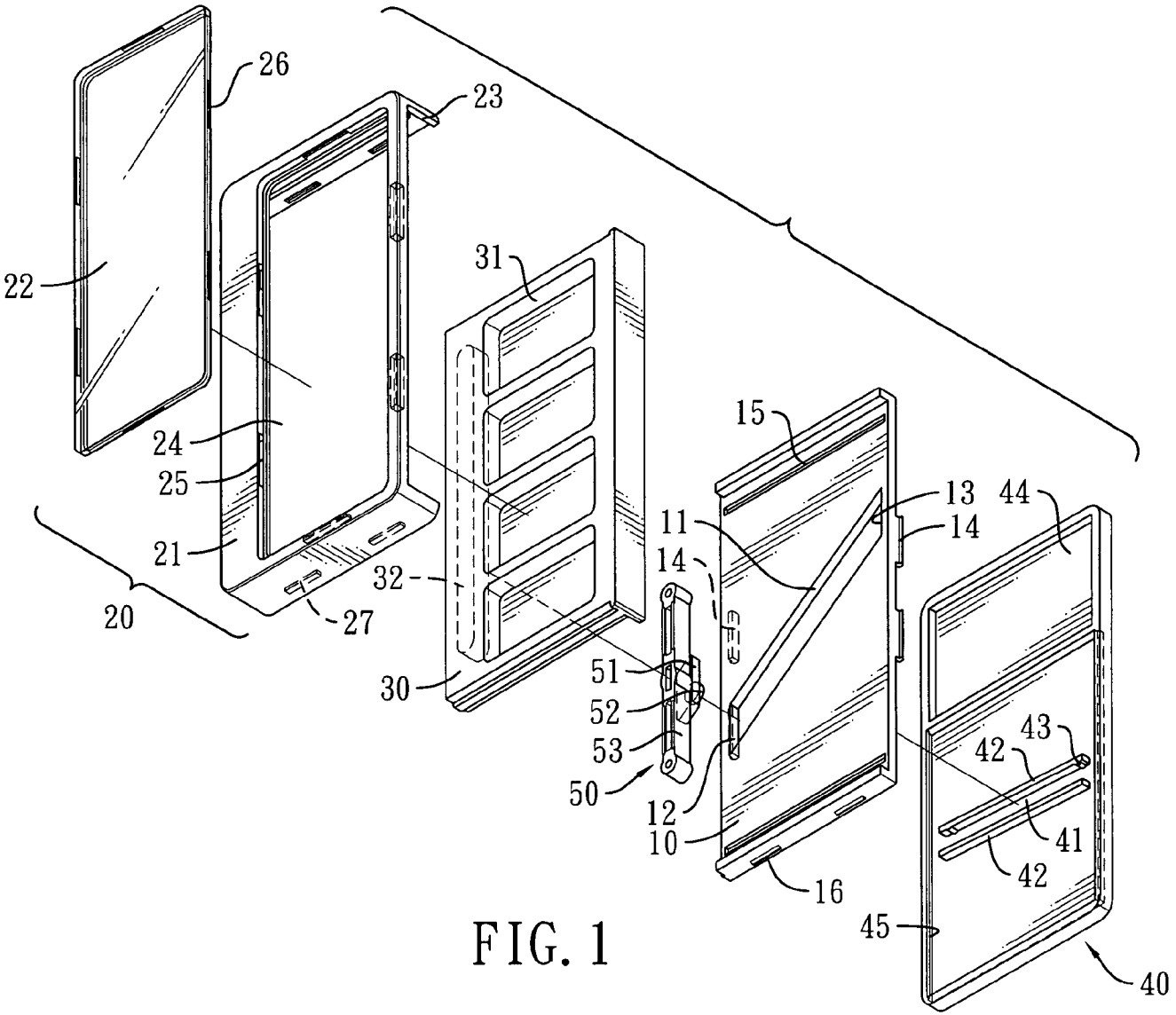
FIG. 1 is an exploded perspective view of a cosmetic container with a transparent window in accordance with the present invention.
Figure 2:
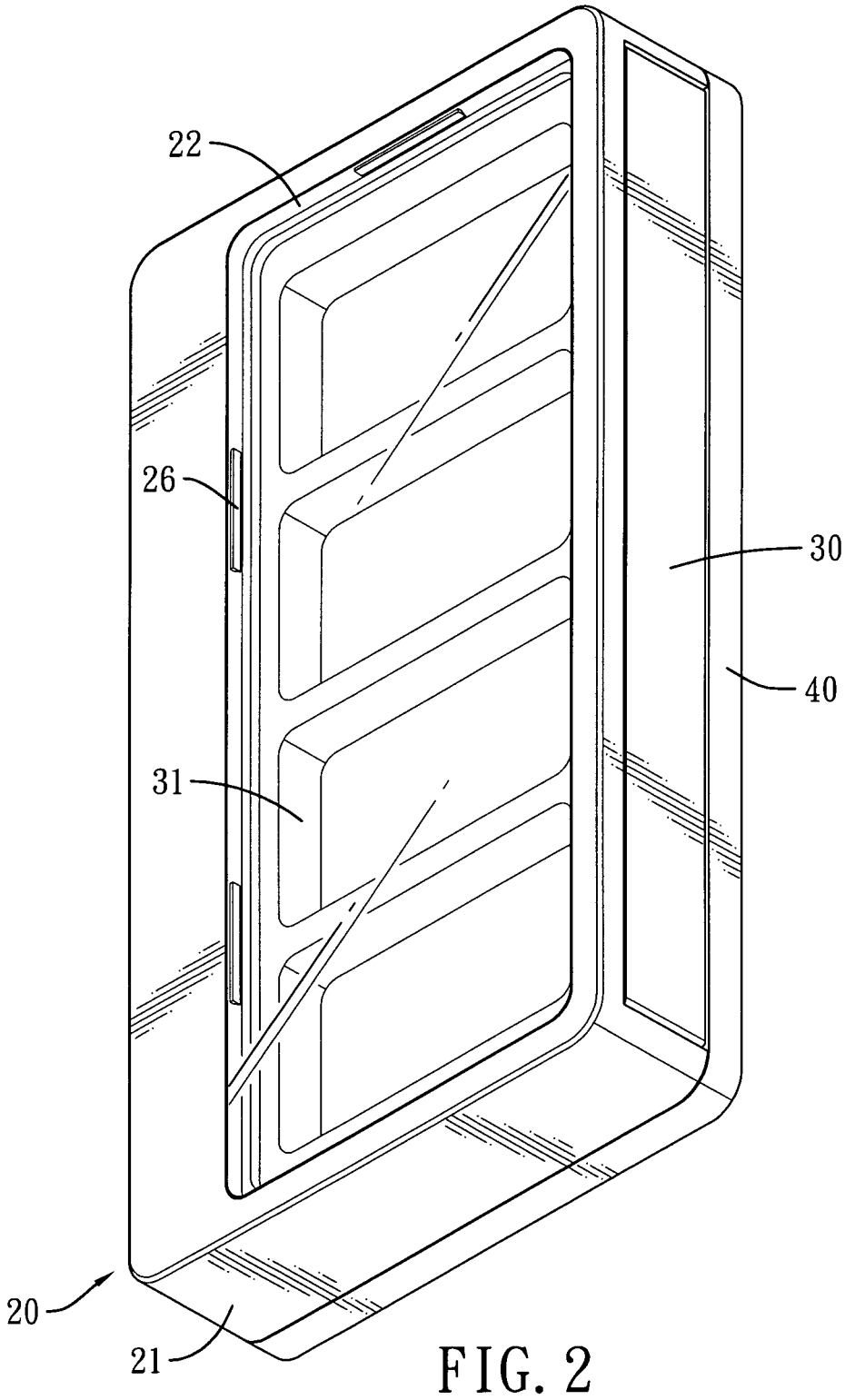
FIG. 2 is a perspective view of the cosmetic container in FIG. 1.

With reference to FIGS. 1 and 2, a cosmetic container with a transparent window in accordance with the present invention comprises a main base 10, a cover 20, a lateral movement base 30, a longitudinal movement base 40 and a transmission element 50.

The main base 10 has an oblique groove 11, multiple longitudinal sliding protrusions 14, two lateral guiding grooves 15, and multiple positioning indentations 16. The oblique groove 11 is formed in the main base 10 and has a first end 12 and a second end 13. The longitudinal sliding protrusions 14 are formed on two opposite longitudinal edges of the main base 10. The lateral guiding grooves 15 are formed in a front surface of the main base 10 and are respectively disposed adjacent to two opposite lateral edges of the main base 10. The positioning indentations 16 are formed on the lateral edges of the main base 10.

The cover 20 is mounted on the front surface of the main base 10 and has a mounting bracket 21, a room and a transparent window 22.

The mounting bracket 21 is mounted on the front surface of the main base 10 and has a side opening 23, a mounting hole 24, an inner peripheral edge, multiple first connecting parts 25 and multiple positioning protrusions 27. The side opening 23 is formed through the mounting bracket 21 and corresponds to one of the longitudinal edges of the main base 10. The mounting hole 24 is formed through the mounting bracket 21. The inner peripheral edge of the mounting bracket 21 is defined around the mounting hole 24 of the mounting bracket 21. The first connecting parts 25 are formed on the inner peripheral edge of the mounting bracket 21. The positioning protrusions 27 are formed on the mounting bracket 21 and respectively correspond to and engage the positioning indentations 16 of the main base 10.

The room is defined between the mounting bracket 21 and the main base 10 and communicates with the mounting hole 24 of the mounting bracket 21. The transparent window 22 is securely mounted on the mounting bracket 21, is mounted in the mounting hole 24 of the mounting bracket 21 and has multiple second connecting parts 26. The second connecting parts 26 are formed on an outer peripheral edge of the transparent window 22 and respectively correspond to and engage the first connecting parts 25 of the mounting bracket 21.

Figure 5:
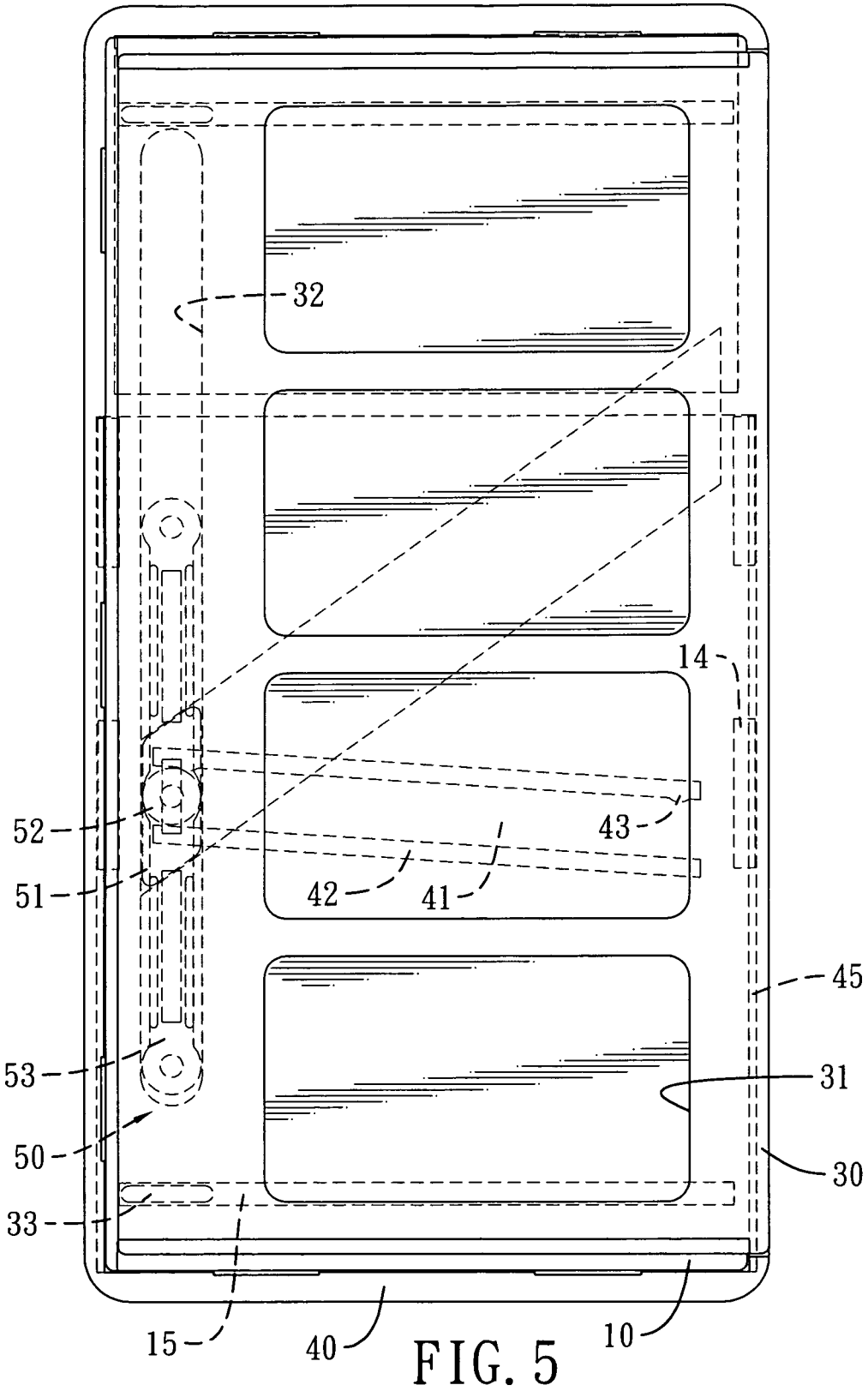
FIG. 5 is a transparent front view of the cosmetic container in FIG. 1.

With further reference to FIG. 5, the lateral movement base 30 is laterally slidably mounted in the room, is selectively mounted through the side opening 23 of the mounting bracket 21 and has at least one mounting recess 31, a longitudinal groove 32 and multiple lateral sliding protrusions 33. The at least one mounting recess 31 is formed in a front surface of the lateral movement base 30, is viewable through the transparent window 22 and is capable of storing cosmetics and even brushes. The longitudinal groove 32 is formed in a rear surface of the lateral movement base 30, corresponds to the oblique groove 11 of the main base 10 and moves between the first and second ends 12, 13 of the oblique groove 11 when the lateral movement base 30 slides laterally relative to the main base 10. The lateral sliding protrusions 33 are formed on the rear surface of the lateral movement base 30 and correspond to and engage the lateral guiding grooves 15 of the main base 10. Thus, a sliding range of the lateral movement base 30 is limited.

The longitudinal movement base 40 is longitudinally slidably mounted on a rear surface of the main base 10 and has two ribs 42, a lateral groove 41 and two stops 43, a mirror mount 44 and two longitudinal guiding grooves 45. The ribs 42 are separately formed on a front surface of the longitudinal movement base 40 and extend laterally. The lateral groove 41 is formed in the front surface of the longitudinal movement base 40, is defined between the ribs 42, corresponds to the oblique groove 11 of the main base 10 and moves between the first and second ends 12, 13 of the oblique groove 11 when the longitudinal movement base 40 slides longitudinally relative to the main base 10. The stops 43 are formed on one of the ribs 42 and protrude into the lateral groove 41. The mirror mount 44 is formed on the front surface and adjacent to an upper edge of the longitudinal movement base 40 and allows a mirror to be mounted on the mirror mount 44 of the longitudinal movement base 40. The longitudinal guiding grooves 45 are respectively formed in two opposite longitudinal edges of the longitudinal movement base 40, and correspond to and engage the longitudinal sliding protrusions 14 of the main base 10. When the longitudinal movement base 40 slides upwardly, the mirror mount 44 protrudes out of the main base 10.

The transmission element 50 is slidably mounted on the main base 10, is connected to the lateral and longitudinal movement bases 30, 40, is driven by the longitudinal movement base 40, drives the lateral movement base 30 and has a slider 51, a first guiding protrusion 52 and a second sliding protrusion 53. The slider 51 is slidably mounted in the oblique groove 11 of the base 10 so the transmission element 50 slides obliquely relative to the main base 10. The first guiding protrusion 52 is formed on the slider 51 and protrudes into the lateral groove 41 of the longitudinal movement base 40. The second guiding protrusion 53 is formed on the slider 51 and protrudes into the longitudinal groove 32 of the lateral movement base 30.

Figure 3:
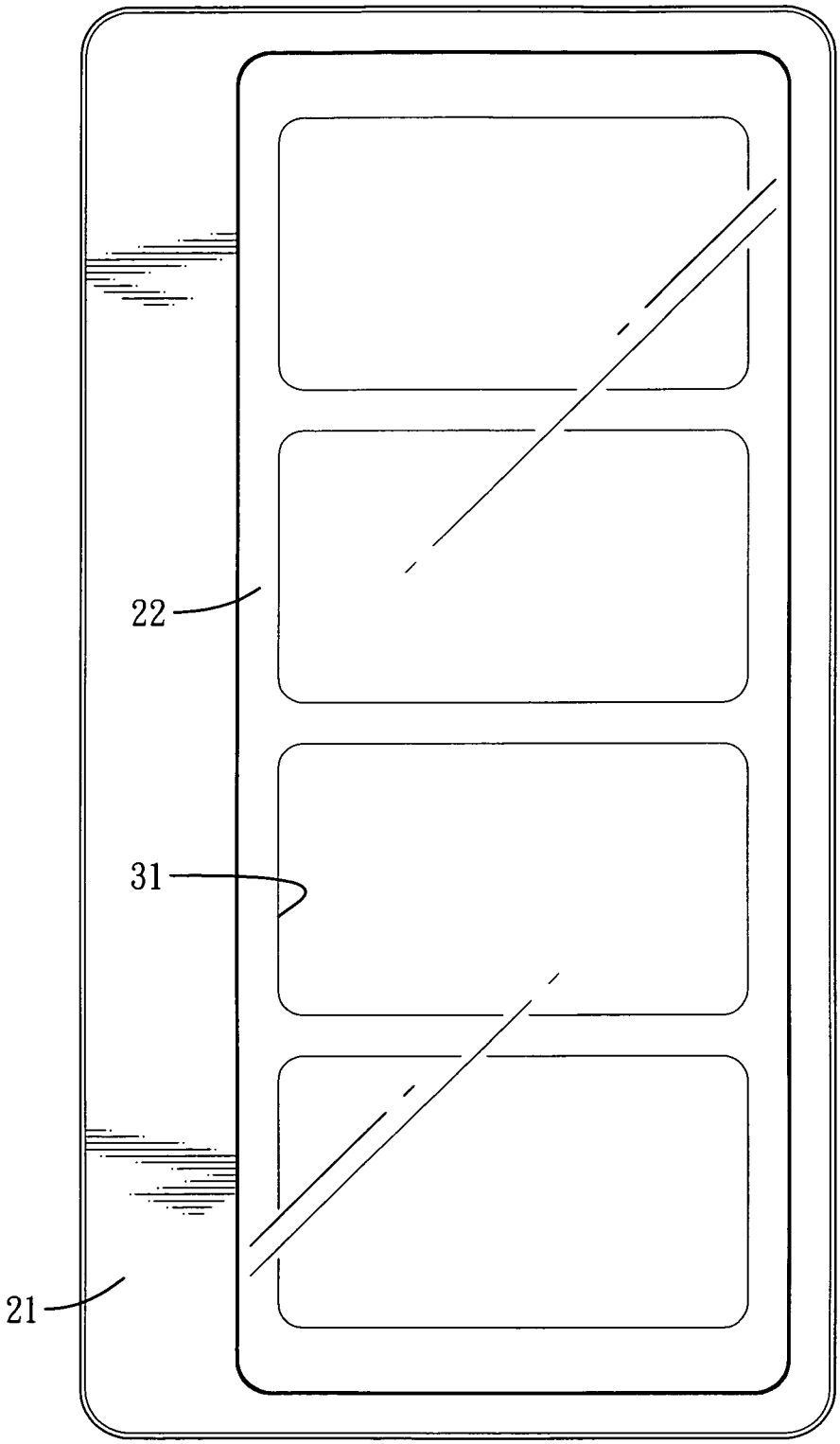
FIG. 3 is a front view of the cosmetic container in FIG. 1.

With further reference to FIG. 3, when the cosmetic container is closed, a user is able to see through the transparent window 22 to recognize the cosmetics that is stored in the at least one mounting recess 31 of the lateral movement base 30.

Figure 4:
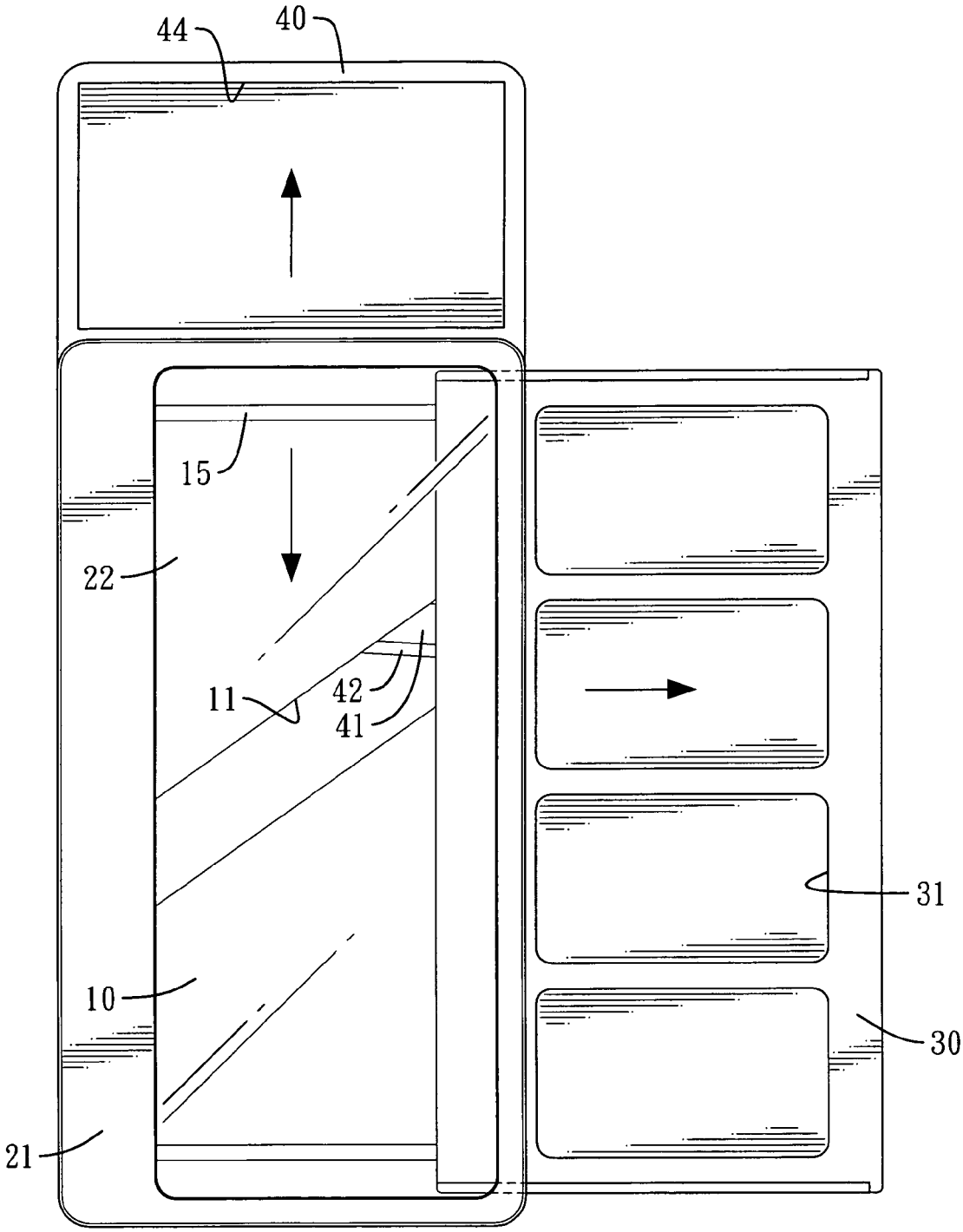
FIG. 4 is an operational front view of the cosmetic container in FIG. 1.
Figure 6:
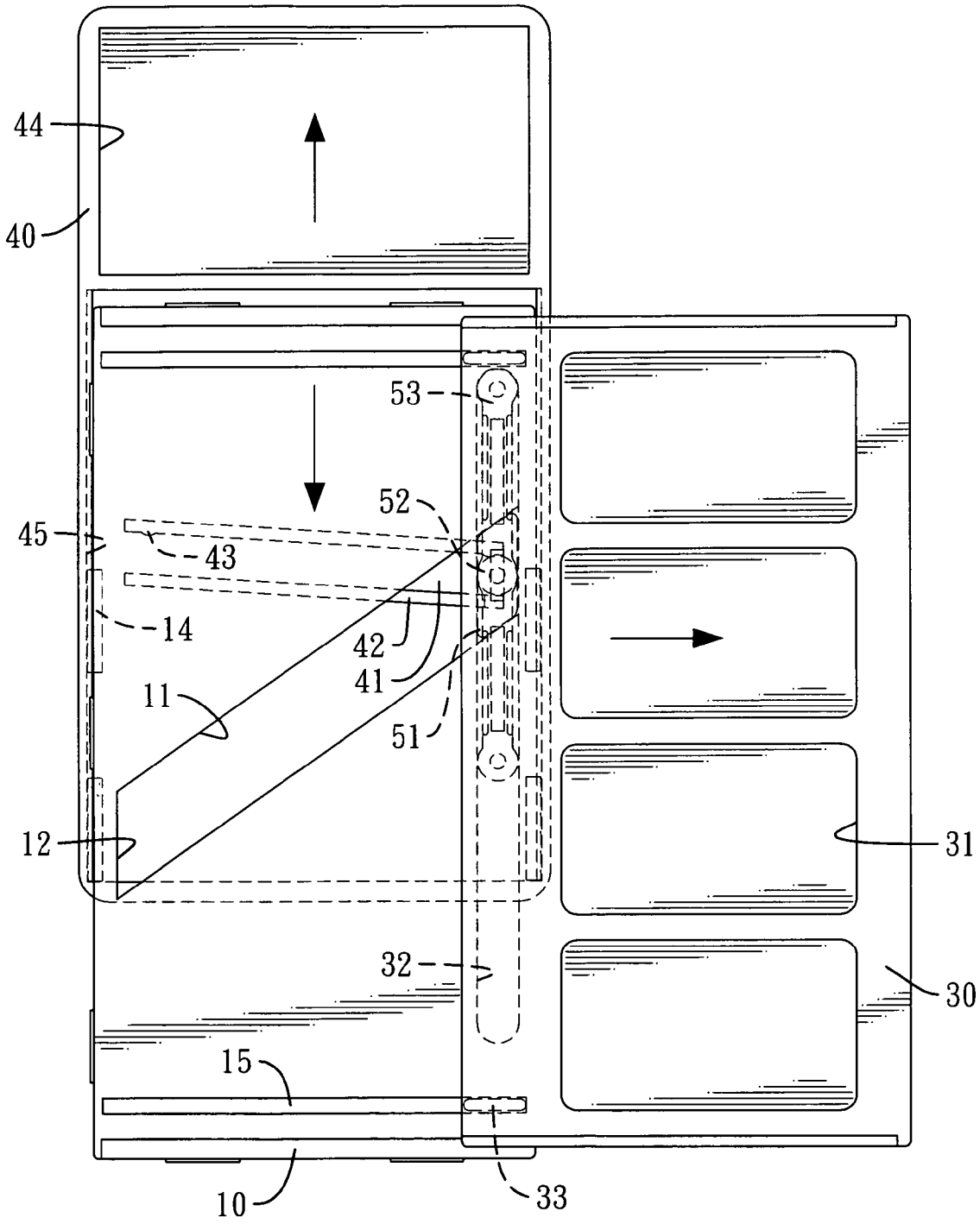
FIG. 6 is an operational transparent front view of the cosmetic container in FIG. 1.

With further reference to FIGS. 4 and 6, when opening the cosmetic container, the user holds the cosmetic container with one hand and pushes the cover 20 downwardly along with the lateral movement base 30 and the main base 10. Then, the slider 51 of the transmission element 50 is forced to slide from the first end 12 to the second end 13 of the oblique groove 11 of the main base 10 and the first guiding protrusion 52 of the transmission element 50 is forced to move along the lateral groove 41 of the longitudinal movement base 40. As the transmission element 50 moves along the oblique groove 11 of the main base 10, the second guiding protrusion 53 of the transmission element 50 slides along the longitudinal groove 32 of the lateral movement base 30 and pushes the lateral movement base 30 to slide laterally out of the room, and the first guiding protrusion 52 of the transmission element 50 pushes the longitudinal movement base 40 to slide longitudinally to allow the mirror mount 44 of the longitudinal movement base 40 to protrude out of the room. Hence, the user is capable of using the cosmetics stored in the at least one mounting recess 31 of the lateral movement base 30 to apply makeup and looks at himself/herself in the mirror that is mounted on the mirror mount 44 of the longitudinal movement base 40.

Afterwards, when the user pushes the cover 20 upwardly along with the lateral movement base 30 and the main base 10, the transmission element 50 slides from the second end 13 to the first end 12 of the oblique groove 11 of the main base 10 and pulls the lateral and longitudinal movement bases 30, 40 back into the room and consequently, the cosmetic container is closed.

The cosmetic container with the transparent window as described has the following advantages. Before opening the cosmetic container, the user is able to recognize kinds and colors of the cosmetics that are stored in the at least one mounting recess 31 of the lateral movement base 30. Therefore, looking for the needful cosmetics is convenient and time efficient. Furthermore, the user is able to hold the cosmetic container with the transparent window with only one hand and push the main base 10 to drive the lateral and longitudinal movement bases 30, 40 to protrude out of or move back into the room of the cosmetic container. Since it is easy and convenient to open or close the cosmetic container, the cosmetic container fits usage demand of the user.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A cosmetic container comprising a a main base;

a cover mounted on a front surface of the main base and having a mounting bracket mounted on the front surface of the main base and having a side opening formed through the mounting bracket;

a room defined between the mounting bracket and the main base; and a transparent window securely mounted on the mounting bracket;

a lateral movement base laterally slidably mounted in the room, selectively mounted through the side opening of the mounting bracket and having at least one mounting recess formed in a front surface of the lateral movement base and being viewable through the transparent window;

a longitudinal movement base longitudinally slidably mounted on a rear surface of the main base; and a transmission element slidably mounted on the main base, connected to the lateral and longitudinal movement bases, driven by the longitudinal movement base and driving the lateral movement base.

2. The cosmetic container as claimed in claim 1, wherein the mounting bracket of the cover further has a mounting hole formed through the mounting bracket;

an inner peripheral edge defined around the mounting hole of the mounting bracket; and multiple first connecting parts formed on the inner peripheral edge of the mounting bracket; and the transparent window of the cover is mounted in the mounting hole of the mounting bracket and has multiple second connecting parts formed on an outer peripheral edge of the transparent window and respectively corresponding to and engaging the first connecting parts of the mounting bracket.

3. The cosmetic container as claimed in claim 1, wherein the main base has an oblique groove formed in the main base and having a first end and a second end;

the lateral movement base further has a longitudinal groove formed in a rear surface of the lateral movement base corresponding to the oblique groove of the main base and moving between the first and second ends of the oblique groove when the lateral movement base slides laterally relative to the main base;

the longitudinal movement base has a lateral groove formed in a front surface of the longitudinal movement base, corresponding to the oblique groove of the main base and moving between the first and second ends of the oblique groove when the longitudinal movement base slides longitudinally relative to the main base; and the transmission element has a slider slidably mounted in the oblique groove of the base;

a first guiding protrusion formed on the slider and protruding into the lateral groove of the longitudinal movement base; and a second sliding protrusion formed on the slider and protruding into the longitudinal groove of the lateral movement base.

4. The cosmetic container as claimed in claim 2, wherein the main base has an oblique groove formed in the main base and having a first end and a second end;

the lateral movement base further has a longitudinal groove formed in a rear surface of the lateral movement base corresponding to the oblique groove of the main base and moving between the first and second ends of the oblique when the lateral movement base slides laterally relative to the main base;

the longitudinal movement base has a lateral groove formed in a front surface of the longitudinal movement base, corresponding to the oblique groove of the main base and moving between the first and second ends of the oblique groove when the longitudinal movement base slides longitudinally relative to the main base; and the transmission element has a slider slidably mounted in the oblique groove of the base;

a first guiding protrusion formed on the slider and protruding into the lateral groove of the longitudinal movement base; and a second sliding protrusion formed on the slider and protruding into the longitudinal groove of the lateral movement base.

5. The cosmetic container as claimed in claim 3, wherein the longitudinal movement base further has two ribs separately formed on the front surface of the longitudinal movement base and extending laterally; and two stops formed on one of the ribs and protruding into the lateral groove of the longitudinal movement base; and the lateral groove of the longitudinal movement base is defined between the ribs.

6. The cosmetic container as claimed in claim 4, wherein the longitudinal movement base further has two ribs separately formed on the front surface of the longitudinal movement base and extending laterally; and two stops formed on one of the ribs and protruding into the lateral groove of the longitudinal movement base; and the lateral groove of the longitudinal movement base is defined between the ribs.

7. The cosmetic container as claimed in claim 5, wherein the longitudinal movement base further has a mirror mount formed on the front surface and adjacent to an upper edge of the longitudinal movement base.

8. The cosmetic container as claimed in claim 6, wherein the longitudinal movement base further has a mirror mount formed on the front surface and adjacent to an upper edge of the longitudinal movement base.

9. The cosmetic container as claimed in claim 7, wherein the main base further has multiple longitudinal sliding protrusions formed on two opposite longitudinal edges of the main base; and the longitudinal movement base further has multiple longitudinal guiding grooves respectively formed in two opposite longitudinal edges of the longitudinal movement base, and corresponding to and engaging the longitudinal sliding protrusions of the main base.

10. The cosmetic container as claimed in claim 8, wherein the main base further has multiple longitudinal sliding protrusions formed on two opposite longitudinal edges of the main base; and the longitudinal movement base further has multiple longitudinal guiding grooves respectively formed in two opposite longitudinal edges of the longitudinal movement base, and corresponding to and engaging the longitudinal sliding protrusions of the main base.

11. The cosmetic container as claimed in claim 9, wherein the main base further has two lateral guiding grooves formed in the front surface of the main base and respectively disposed adjacent to two opposite lateral edges of the main base; and the lateral movement base further has multiple lateral sliding protrusions formed on the rear surface of the lateral movement base and corresponding to and engaging the lateral guiding grooves of the main base.

12. The cosmetic container as claimed in claim 10, wherein the main base further has two lateral guiding grooves formed in the front surface of the main base and respectively disposed adjacent to two opposite lateral edges of the main base; and the lateral movement base further has multiple lateral sliding protrusions formed on the rear surface of the lateral movement base and corresponding to and engaging the lateral guiding grooves of the main base.

13. The cosmetic container as claimed in claim 11, wherein the main base further has multiple positioning indentations formed on the lateral edges of the main base; and the mounting bracket further has multiple positioning protrusions formed on the mounting bracket and respectively corresponding to and engaging the positioning indentations of the main base.

14. The cosmetic container as claimed in claim 12, wherein the main base further has multiple positioning indentations formed on the lateral edges of the main base; and the mounting bracket further has multiple positioning protrusions formed on the mounting bracket and respectively corresponding to and engaging the positioning indentations of the main base.

* * * * *